US007950070B2

(12) United States Patent
Beven

(10) Patent No.: US 7,950,070 B2
(45) Date of Patent: May 31, 2011

(54) SHORTS COMPRISING A WAISTBAND WITH A SELF-GRIPPING STRIP

(75) Inventor: Yannick Beven, Guethary (FR)

(73) Assignee: QS Holdings SARL, Luxembourg (LU)

( * ) Notice: Subject to any disclaimer, the term of this patent is extended or adjusted under 35 U.S.C. 154(b) by 412 days.

(21) Appl. No.: 12/167,939

(22) Filed: Jul. 3, 2008

(65) Prior Publication Data

US 2009/0007314 A1 Jan. 8, 2009

(51) Int. Cl.
*A41D 13/02* (2006.01)

(52) U.S. Cl. ..... 2/235; 2/237; 2/234

(58) Field of Classification Search ..... 2/912, 76, 2/234–238

See application file for complete search history.

(56) References Cited

U.S. PATENT DOCUMENTS

| | | | | | |
|---|---|---|---|---|---|
| 143,947 | A * | 10/1873 | Weil | | 2/237 |
| 321,962 | A * | 7/1885 | Goedman | | 2/237 |
| 666,246 | A * | 1/1901 | Anderson | | 2/237 |
| 1,832,687 | A * | 11/1931 | Boshnack | | 2/234 |
| 1,937,356 | A * | 11/1933 | Neustadt | | 2/237 |
| 2,281,872 | A * | 5/1942 | Donnelly | | 2/237 |
| 5,191,659 | A * | 3/1993 | Backus | | 2/227 |
| 5,598,586 | A * | 2/1997 | Munjone | | 2/237 |
| 6,081,930 | A * | 7/2000 | Phillips | | 2/237 |
| 6,199,215 | B1 * | 3/2001 | Biggerstaff | | 2/234 |
| 6,665,882 | B1 * | 12/2003 | Pedrick | | 2/228 |
| 6,684,410 | B2 * | 2/2004 | Robinett et al. | | 2/228 |
| 6,715,155 | B2 * | 4/2004 | Duflos | | 2/237 |
| 7,124,448 | B2 * | 10/2006 | Davenport | | 2/229 |
| 7,174,574 | B2 * | 2/2007 | Fontes | | 2/235 |
| 7,516,499 | B2 * | 4/2009 | Gardner, III | | 2/221 |
| 7,757,308 | B2 * | 7/2010 | Oomae | | 2/237 |
| 2005/0273907 | A1 * | 12/2005 | Fontes | | 2/235 |
| 2005/0283883 | A1 * | 12/2005 | Fontes | | 2/238 |
| 2007/0028363 | A1 | 2/2007 | Hansen | | |
| 2007/0028364 | A1 * | 2/2007 | Oomae | | 2/237 |
| 2007/0050890 | A1 * | 3/2007 | Purnell | | 2/235 |
| 2009/0038046 | A1 * | 2/2009 | Moore et al. | | 2/67 |

FOREIGN PATENT DOCUMENTS

| | | |
|---|---|---|
| JP | 11081011 | 3/1999 |

* cited by examiner

*Primary Examiner* — Katherine Moran
*Assistant Examiner* — Richale L Quinn
(74) *Attorney, Agent, or Firm* — Snell & Wilmer L.L.P.

(57) ABSTRACT

Shorts comprising a rear face and a front face (10, 12) having a fly (18). The shorts further include a waistband (20) integral with the front and rear faces, the waistband extending between first and second ends (20*a*, 20*b*) placed on either side of the fly.

A tab (22) extends the first end (20*a*) as far as a free end (23) and is placed so as to cover the second end (20*b*) of the waistband. The tab has a self-gripping strip (24) placed facing a complementary self-gripping strip integral with the second end (20*b*) of the waistband.

A lace (29) connects the tab (22) to the second end (20*b*) of the waistband and passes through two respective holes (30, 32) made in the second end (20*b*) of the waistband so as to be able to be tied on the inside of the waistband.

17 Claims, 2 Drawing Sheets

SHORTS COMPRISING A WAISTBAND WITH A SELF-GRIPPING STRIP

The present invention relates to shorts comprising a waistband with a self-gripping strip. More particularly, the invention relates to shorts, comprising:

a rear face and a front face, the front face having a fly;

a waistband integral with said front and rear faces, the waistband extending between first and second ends, said first and second ends being placed on either side of the fly; and a tab extending the first end as far as a free end and placed so as to cover the second end of the waistband, the tab having a self-gripping strip placed facing a complementary self-gripping strip integral with the second end of the waistband.

Document U.S. Pat. No. 7,174,574 discloses an example of such shorts. However, shorts of this kind have the drawback of being able to be opened inopportunely, especially during sudden movements due for example to undertaking a sporting activity, especially surfing or the like.

It is an object of the present invention in particular to alleviate these drawbacks.

For this purpose, according to the invention, shorts of the kind in question are characterized in that a lace extending between two free ends connects the free end of the tab to the second end of the waistband and in that the two free ends of the lace pass through two respective holes made in the second end of the waistband so as to be able to be tied on the inside of the waistband.

This makes it possible in particular to ensure reliable, easy and rapid closure in use, occasioning no impediment to a user, especially during a sporting activity.

In preferred embodiments of the invention, one or more of the following arrangements may optionally be furthermore employed:

the lace also passes through a hole made in the tab;

said hole is made in the free end of the tab;

the free end of the tab has no self-gripping strip;

the lace is fastened to the second end of the waistband;

the lace is stitched to the second end of the waistband;

the complementary self-gripping strip is placed between said two holes and the fly, said two holes being made in a part of the waistband that does not have a self-gripping strip; and the shorts further include a device for closing the fly.

Other aspects, objects and advantages of the invention will become apparent on reading the description of several embodiments.

The invention will be better understood from the drawings, in which:

In the various figures, the same references denote identical or similar elements.

FIG. 1 shows shorts, such as shorts for surfing or another sporting activity, according to one embodiment of the invention.

Figure 1:
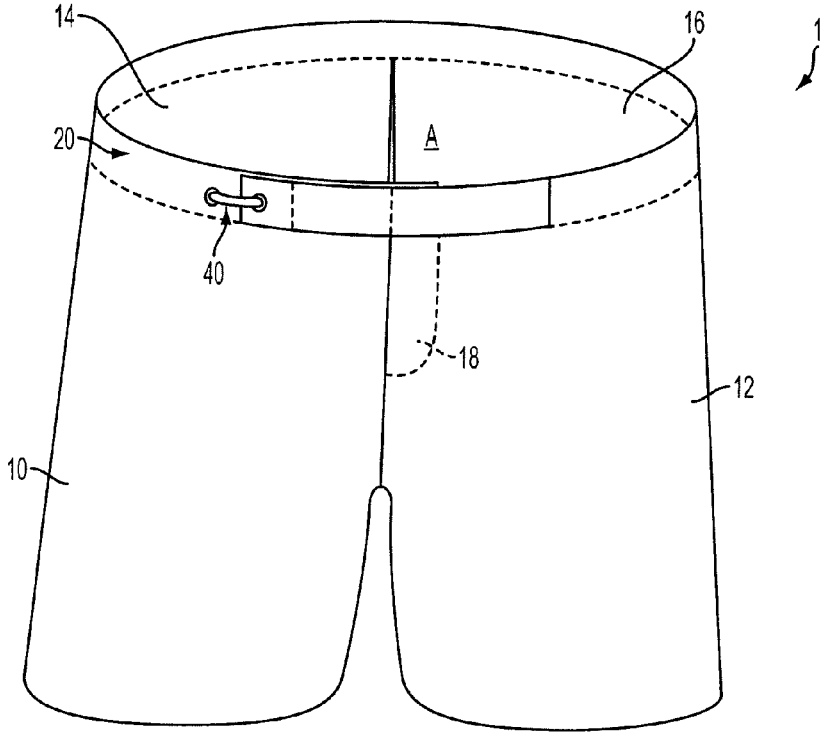
FIG. 1 is a perspective view of shorts according to a first embodiment of the invention, in the closed state.

The shorts 1 may be produced for example from four fabric portions 10, 12, 14, 16 stitched together so as to define an interior volume A capable of accommodating the lower trunk and two legs of a user. The portions 10 and 12 form a front face of the shorts, while the fabric portions 14 and 16 form a rear face of the shorts.

The front face, between the front right and front left fabric pieces 10, 12, defines a fly 18 in its upper part.

The shorts 1 further include a closure device 18*a*, 18*b* which may be opened and closed alternately, so as to reversibly close the fly 18 of the shorts. The embodiment illustrated includes for example (FIGS. 2 and 3) two complementary self-gripping strips 18*a*, 18*b* fastened on either side of the fly 18 so as to constitute this removable closure. However, other embodiments may use a zip closure or even press studs or the like.

The shorts 1 further include a waistband 20 stitched to the upper edges of the fabric pieces 10 to 16. The waistband 20 extends between a left first end 20*a* and a right second end 20*b*. The ends 20*a*, 20*b* are attached in the region of the fly 18, on either side of the latter. In a variant of the present embodiment, the waistband 20 may be made from a part integral with the fabric pieces 10 to 16 constituting the legs of the shorts.

Figure 2:
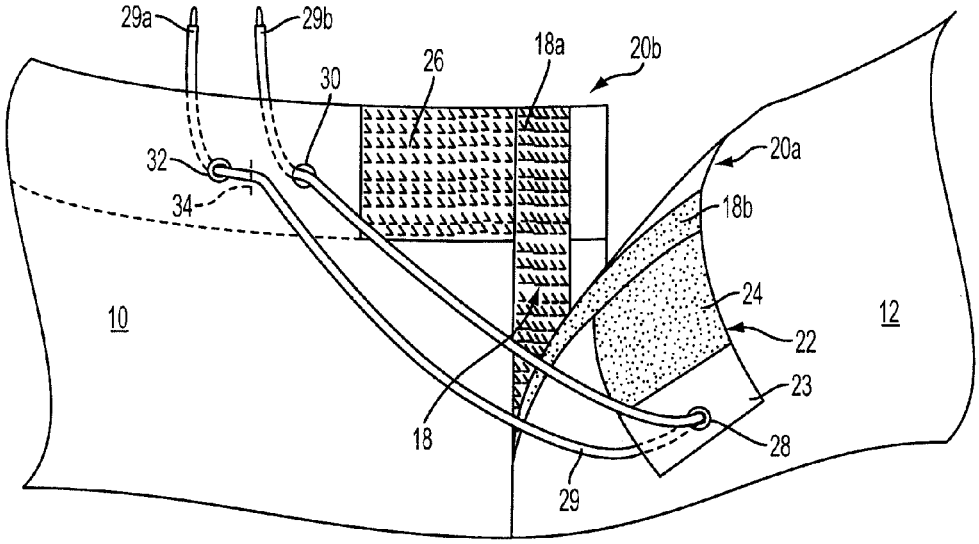
FIG. 2 is a detailed view in perspective showing the front part of the shorts of FIG. 1, in the open state.

FIG. 2 illustrates in more detail the waistband 20 and the fly 18 in the open position.

The waistband 20 includes a tab 22 extending the first end 20*a* of the waistband towards the right, as far as a free end 23. The free end 23 covers the right-hand part of the waistband 20.

The tab 22 has a proximal part (near the left-hand end 20*a* of the waistband), the inner face of which is provided with a first self-gripping strip 24, such as a strip of Velcro® or the like.

This first self-gripping strip 24 is intended to be removably fixed to a complementary self-gripping strip 26 (for example a complementary strip of the Velcro® type) which is integral with the outer face of the second end 20*b* of the waistband 20.

The self-gripping strips 24, 26 may be stitched or bonded to the tab 22 and to the waistband 20, respectively.

The tab 22 further includes an eyelet 28 defining an orifice in its free end 23. Passing through the eyelet 28 is a lace 29. The ends 29*a*, 29*b* of the lace also pass through two complementary eyelets 30, 32 (defining two respective orifices) also located on the second end of the waistband 20, preferably in part of the waistband not having a self-gripping strip. Said complementary self-gripping strip 26 is placed between the eyelets 30, 32 and the fly 28.

To prevent the lace 29 being lost, it may optionally be fixed in place by a stitch 34 between the eyelets 30, 32.

These two closure means, on the one hand the self-gripping strips 24, 26, and on the other hand the lace 29 through the eyelets 28, 30 and 32, ensures reliable closure of the shorts 1, which remains rapid to effect and which occasions no impediment to a user.

The shorts 1 are closed by closing the closure device 18*a*, 18*b* of the fly, then by fixing the self-gripping strips 24, 26 together and, finally, tightening the lace 29 so as to align the eyelet 28 in the tab 22 with the eyelet 30 in the right-hand part of the waistband, and to knot the free ends 29*a*, 29*b* of the lace together inside the shorts.

Figure 3:
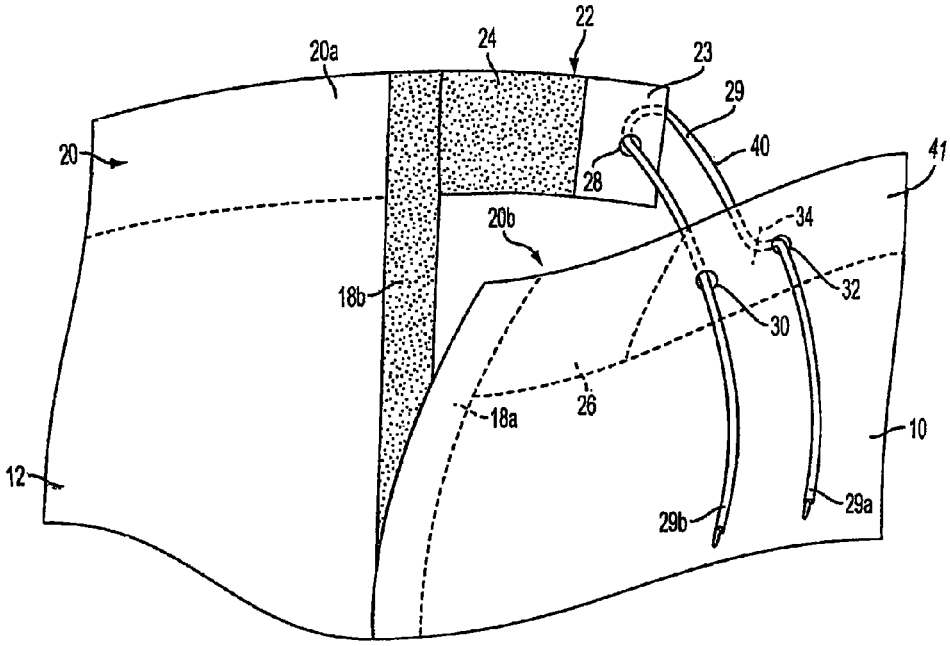
FIG. 3 is a view similar to FIG. 2, the front part being seen from the inside of the shorts.

Only a small lace part 40 (see FIG. 1) is on the outside of the shorts in the closed state, so that the lace does not impede the user and does not risk becoming unknotted. FIG. 3 shows an inside view of the pair of shorts 1 according to an embodiment of the present invention. The waistband 20 may have the first end 20*a* coupled to the front left fabric portion 12 and the second end 20*b* coupled to the front right fabric portion 10. The first end 20*a* of the waistband 20 may be detachably coupled to the second end 20*b* to close the waistband 20, thereby forming a loop. The tab 22 may extend from the first end 20*a*. The tab 22 may include the first self-gripping strip 24 and the free end 23. The free end 23 may extend from the first self-gripping strip 24. The second end 20*b* may include the second self-gripping strip 26 and a section 41. The second self-gripping strip 26 may be detachably coupled to the first self-gripping strip 24. The coupling between the first 24 and second 26 self-gripping strips may reinforce the coupling between the closure devices 18*a* and 18*b*.

The section 41 may be positioned adjacent to the second self-gripping strip 26, and it may be used for receiving the lace 29. In one embodiment, the section 41 may be free of any self-gripping strip, and it may be made of a material similar to the fabric of the front right fabric portion 10. The free end 23 of the tab 22 may define the first eyelet 28, while the section 41 of the second end 20*b* may define the second eyelet 30 and the third eyelet 32. When the first self-gripping strip 24 is attached to the second self-gripping strip 26, the free end 23 may overlap with the section 41, which may be a part of the closed waistband 20.

When the free end 23 substantially overlaps with the section 41, the first eyelet 28 of the free end 23 may align with the second eyelet 30 of the section 41. In one embodiment, the second self-gripping strip 26 may be free from overlapping with the free end 23 of the tab 22 when the first self-gripping strip 24 of the tab 22 is attached to the second self-gripping strip 26 of the second end 20*b*. In another embodiment, the section 41 of the second end 20*b* may be free from overlapping with the first end 20*a* when the first self-gripping strip 24 of the tab 22 is attached to the second self-gripping strip 26 of the second end 20*b*.

The lace 29 may have a first end 29*b*, a second end 29*a*, and a mid section (small lace part) 40. In one embodiment, the mid section 40 may be attached to the section 41 by the stitch 34. The mid section 40 may be stitched between the second 30 and third 32 eyelets. The first end 29*b* of the lace 29 may penetrate the free end 23 through the first eyelet 28 and penetrate the section 41 through the second eyelet 30. The second end 29*a* of the lace 29 may penetrate the section 41 through the third eyelet 32. As such, the lace 29 may link the free end 23 of the tab 22 to the section 41 of the second end 20*b*. When a knot is tied between the first 29*b* and second 29*a* ends, the lace 29 may be used for fastening or securing the free end 23 of the tab 22 to the section 41 of the second end 20*b*.

The first eyelet 28 of the free end 23 and the third eyelet 32 of the section 41 may define a distance, which may be adjusted by the first end 29*b* and/or second end 29*a* of the lace 29. Particularly, the first end 29*b* and the second end 29*a* may be maneuvered to increase and/or decrease the distance defined between the first eyelet 28 and the third eyelet 32.

The invention claimed is:

1. A pair of shorts, comprising:

a rear face and a front face;

a waistband coupled to the front and rear faces, the waistband having first and second ends;

a tab extending from the first end of the waistband, the tab having a self-gripping strip and a free end, the self-gripping strip configured to be flexibly attached to the second end of the waistband to close the waistband, the free end configured to overlap with a portion of the closed waistband; and a lace configured to secure the free end of the tab to the second end of the waistband, wherein the second end includes a self-gripping strip configured to be flexibly coupled to the self-gripping strip of the tab and a grip-free section configured to overlap with the free end of the tab, the free end of the tab defines a first eyelet, the grip-free section of the second end defines a second eyelet and a third eyelet, the second eyelet is configured to align with the first eyelet of the free end when the free end substantially overlaps with the grip-free section, and the lace has a first end and a second end, such that the first end is configured to pass through the first and second eyelets and the second end is configured to pass through the third eyelet.

2. The pair of shorts of claim 1, wherein the free end of the tab is free of the self-gripping strip.

3. The pair of shorts of claim 1, wherein the lace is configured to fasten the free end of the tab to the second end of the waistband.

4. The pair of shorts of claim 1, wherein the lace is stitched to the second end of the waistband.

5. The pair of shorts of claim 1, wherein the self-gripping strip of the second end is configured to be free from overlapping with the free end of the tab when the self-gripping strip of the tab is attached to the self-gripping strip of the second end.

6. The pair of shorts of claim 1, further comprising:

a fly coupled between the first and second ends of the waistband; and a device for closing the fly.

7. A pair of shorts, comprising:

front left and front right portions;

a waistband having:

a first end coupled to the front left portion, a first self-gripping strip extending from the first end, a free end extending from the first self-gripping strip, the free end defining a first eyelet, and a second end having a second self-gripping strip and a lace receiving section, the second self-gripping strip configured to be detachably coupled to the first self-gripping strip, the lace receiving section defining a second eyelet and a third eyelet; and a lace configured to penetrate through the first, second, and third eyelets, thereby linking the free end to the lace receiving section of the second end.

8. The pair of shorts of claim 7, wherein the lace receiving section is free from overlapping with the first end.

9. The pair of shorts of claim 7, wherein the lace includes:

a first end configured to align the first eyelet of the free end with the second eyelet of the lace receiving section of the second end, and a second end configured to adjust a distance defined between the first eyelet of the free end and the third eyelet of the lace receiving section of the second end.

10. The pair of shorts of claim 7, wherein the lace is configured to fasten the free end to the lace receiving section of the second end.

11. The pair of shorts of claim 7, wherein the free end is configured to overlap with the lace receiving section of the second end when the first self-gripping strip is attached to the second self-gripping strip.

12. The pair of shorts of claim 7, further comprising:

a flyer coupled between the front left and front right portions; and a device configured to close the flyer.

13. A waistband, comprising:

a first end;

a tab extending from the first end, the tab having a first self-gripping strip and a free end; and a second end configured to be coupled to the first end, the second end having a second self-gripping strip and a section adjacent to the second self-gripping strip, the second self-gripping strip configured to be detachably coupled to the first self-gripping strip, the section configured to overlap with the free end of the tab, wherein the free end of the tab defines a first eyelet, the section of the second end defines a second eyelet and a third eyelet positioned adjacent to the second eyelet, and the second eyelet of the section configured to align with the first eyelet of the free end when the free end substantially overlaps with the section of the second end.

14. The waistband of claim 13, wherein the section is free of self-gripping strip.

15. The waistband of claim 13, further comprising:

a lace having a first end, a second end, and a mid section coupled between the first and second ends, the first end of the lace configured to pass through the first eyelet of the free end and the second eyelet of the section of the second end, the second end of the lace configured to pass through the third eyelet of the section of the second end.

16. The waistband of claim 15, wherein the mid section of the lace is attached to the section of the second end and positioned between the second and third eyelets.

17. The waistband of claim 15, wherein:

the first eyelet of the free end and the third eyelet of the second end define a distance therebetween, and the lace is maneuverable to adjust the distance between the first and third eyelets.

* * * * *